US008970132B2

(12) United States Patent
Lin et al.

(10) Patent No.: US 8,970,132 B2
(45) Date of Patent: Mar. 3, 2015

(54) LIGHTING DEVICE CONTROLLING CHIP, APPARATUS, SYSTEM AND ADDRESSING METHOD THEREOF

(75) Inventors: Chun-Fu Lin, Hsinchu (TW); Chun-Ting Kuo, Pingtung County (TW); Cheng-Han Hsieh, Hsinchu County (TW)

(73) Assignee: My-Semi Inc., Hsinchu County (TW)

( * ) Notice: Subject to any disclaimer, the term of this patent is extended or adjusted under 35 U.S.C. 154(b) by 671 days.

(21) Appl. No.: 13/231,955

(22) Filed: Sep. 13, 2011

(65) Prior Publication Data

US 2012/0139451 A1 Jun. 7, 2012

(30) Foreign Application Priority Data

Dec. 6, 2010 (TW) ..... 99142369 A

(51) Int. Cl.
*H05B 37/02* (2006.01)

(52) U.S. Cl.
CPC ..... *H05B 37/0254* (2013.01)
USPC ..... 315/307; 315/312

(58) Field of Classification Search
CPC .... H05B 37/00; H05B 37/02; H05B 37/0254; H05B 33/0842; H05B 33/086
USPC ..... 315/291, 307, 308, 312
See application file for complete search history.

(56) References Cited

U.S. PATENT DOCUMENTS

| | | | | |
|---|---|---|---|---|
| 7,994,723 | B2 | 8/2011 | Budde et al. | |
| 2008/0012506 | A1* | 1/2008 | Mueller et al. | 315/294 |
| 2009/0289578 | A1 | 11/2009 | Peng | |
| 2011/0043124 | A1* | 2/2011 | Johnston et al. | 315/250 |

FOREIGN PATENT DOCUMENTS

| | | |
|---|---|---|
| CN | 101233790 | 7/2008 |
| CN | 101603648 A | 12/2009 |
| TW | 200711534 | 3/2007 |
| TW | 200950578 | 12/2009 |

OTHER PUBLICATIONS

Taiwan Patent Office, Office action issued on Sep. 17, 2013.
China Patent Office, Office action issued on Sep. 3, 2014.

* cited by examiner

*Primary Examiner* — Jimmy Vu
(74) *Attorney, Agent, or Firm* — Li & Cai Intellectual Property (USA) Office

(57) ABSTRACT

A lighting device controlling chip, an apparatus, a system and an addressing method thereof are provided. The lighting device has a trigger terminal for receiving a first setting voltage, an output terminal for outputting a second setting voltage and a signal receiving interface for receiving a data packet having a plurality of serially transmitted data slots. The lighting device controlling chip may automatically set an address thereof according to a voltage level of the first setting voltage and a counting signal corresponding to the number of the received data slots.

12 Claims, 3 Drawing Sheets

LIGHTING DEVICE CONTROLLING CHIP, APPARATUS, SYSTEM AND ADDRESSING METHOD THEREOF

BACKGROUND

1. Technical Field

The present disclosure relates to a lighting device controlling apparatus, and more particularly to a lighting device controlling chip, apparatus, system, and addressing method thereof in compliance with DMX512 standard.

2. Description of Related Art

Light emitting diode (LED) has been gaining popularity in terms of its widespread applications in lighting. One most commonly used controlling standard for LED lighting is DMX512 standard. DMX512 standard is a digital communication interface standard mainly for applying the communication protocol among the lighting devices that including data format for data transmission, electrical characteristics and connector type. DMX512 was first developed by the Engineering Commission of United States Institute for Theatre Technology (USITT). There are many lighting-control protocols applied on the lighting devices before the establishment of the DMX512 agreement. However, as system complexity increases, compatibility requirements demands between different products rises, as the result DMX512 was developed.

In DMX512, data are asynchronously and serially transmitted (asynchronous serial format), and each data packet includes a START CODE and with 512 channel data in maximum, wherein the first data slot in the data packet (slot 0 or time slot) is for the transmission of the START CODE with the second data slot (slot 1) to the $512^{nd}$ data slot (slot 511) configured for the transmission of the channel data. Currently, intelligent lights in either international or domestic employ the DMX512 data format for programming The data transmission speed of DMX512 is 250K, in other words, every bit is 4 us of the standard packet length, and the length of each bit is between 3.92 us to 4.08 us in accordance to the agreement.

When DMX512 standard or the like is utilized for controlling the lighting devices, a conventional addressing of a controlling chip, whether it is on basis of pin configuration or having a corresponding address being written into the controlling chip in a predetermined order automatically. Regardless which methods are used, it is commonly known that any controlling chips requires writing the address individually, and may not detect the position and sequence automatically.

SUMMARY

The present disclosure provides a lighting device controlling chip, apparatus and system, wherein the individual lighting device controlling chip is able to recognize the self-sequence and set the address thereof automatically.

The present disclosure provides a lighting device controlling method utilizing the number of the received data slots to serve the above-mentioned purpose.

The present disclosure provides a lighting device controlling chip adapted to drive one or a plurality of lamps according to a first setting voltage and a data packet, having a plurality of serially transmitted data slots. The lighting device controlling chip includes a trigger terminal for receiving the first setting voltage, an output terminal for outputting a second setting voltage and a signal receiving interface for receiving the data packet. The lighting device controlling chip determines an address thereof according to the voltage level of the first setting voltage and the counting signal corresponding to the number of the received data slots.

According to an exemplary embodiment of the present disclosure, when detecting the voltage level of the first setting voltage has been set to a predetermined voltage the lighting device controlling chip may determine the address of the lighting device controlling chip according to the counting signal corresponding to the number of the received data slots. The lighting device controlling chip, whose address has been set accordingly, may set the second setting voltage to the predetermined voltage after an interval of a predetermined number of the data slots.

According to an exemplary embodiment of the present disclosure, the above-mentioned lighting device controlling chip includes a counter, an address setting unit and a driving unit. The counter is coupled to the signal receiving interface and the trigger terminal, for counting the number of the received data slots and outputting the counting signal corresponding to the number of the received data slots as the voltage level of the first setting voltage is set to the predetermined voltage. The address setting unit is coupled to the counter for setting the address according to the counting signal. The driving unit is coupled to the address setting unit and the receiving signal interface, for driving one or a plurality of lamps connected to the lighting device controlling chip according to the address by accessing one or a plurality of the data slots received in the data packet.

According to another exemplary embodiment of the present disclosure, wherein the above-mentioned data packet is in compliance with DMX512 standard, the first setting voltage is a direct current (DC) voltage level and the signal receiving interface is complying with EIA-485 standard.

Another exemplary embodiment of the present disclosure provides a lighting device controlling apparatus, adapted to drive a plurality of lamps according to a first setting voltage and a data packet having a plurality of serially transmitted data slots. The lighting device controlling apparatus includes a first lighting device controlling chip and a second lighting device controlling chip. The first lighting device controlling chip includes a first trigger terminal for receiving the first setting voltage, a first output terminal for outputting a second setting voltage and a first signal receiving interface for receiving the data packet. The second lighting device controlling chip includes a second trigger terminal coupled to the first output terminal, a second output terminal, and a second signal receiving interface for receiving the data packet. The first lighting device controlling chip may determine a first address of the first lighting device controlling chip according to the voltage level of the first setting voltage and a first counting signal corresponding to the number of the received data slots. The second lighting device controlling chip determines a second address of the second lighting device controlling chip according to the voltage level of the second setting voltage and a second counting signal corresponding to the number of the received data slots.

The present disclosure further provides a lighting system including a plurality of lamps and the above-mentioned lighting device controlling apparatus. The lighting device controlling apparatus is coupled to those lamps and adapted to drive those lamps according to a first setting voltage and a data packet, wherein the lighting device controlling apparatus is same as the above-mentioned one and the descriptions are hereby omitted.

Form another point of view, the present disclosure provides a method of addressing the lighting device controlling chip which is adapted to a lighting device controlling chip and the lighting device controlling chip having a trigger terminal for receiving a first setting voltage, an output terminal for outputting a second setting voltage, and a signal receiving interface for receiving a data packet having a plurality of serially transmitted data slots. The method of addressing the lighting device controlling chip includes counting the number of the received data slots of the lighting device controlling chip for generating a counting signal, and determining the address of the lighting device controlling chip according to the voltage level of the first setting voltage and the counting signal corresponding to the number of the received data slots.

In summary, the lighting device controlling chip of the present disclosure may set the address automatically according to the received data slots when triggered. The lighting device controlling chip of the present disclosure may detect the position in terms of the sequence among a group of the lighting device controlling chips automatically without either external setting mechanism in place or being set up one by one. As the result, the lighting device controlling chip of the present disclosure may change the arrangement of the individual chips randomly, and the individual chips may set the corresponding address when receiving the data packet automatically.

In order to further understand the techniques, means and effects the present disclosure, the following detailed descriptions and appended drawings are hereby referred, such that, through which, the purposes, features and aspects of the present disclosure can be thoroughly and concretely appreciated; however, the appended drawings are merely provided for reference and illustration, without any intention to be used for limiting the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DESCRIPTION OF THE EXEMPLARY EMBODIMENTS

Figure 1:
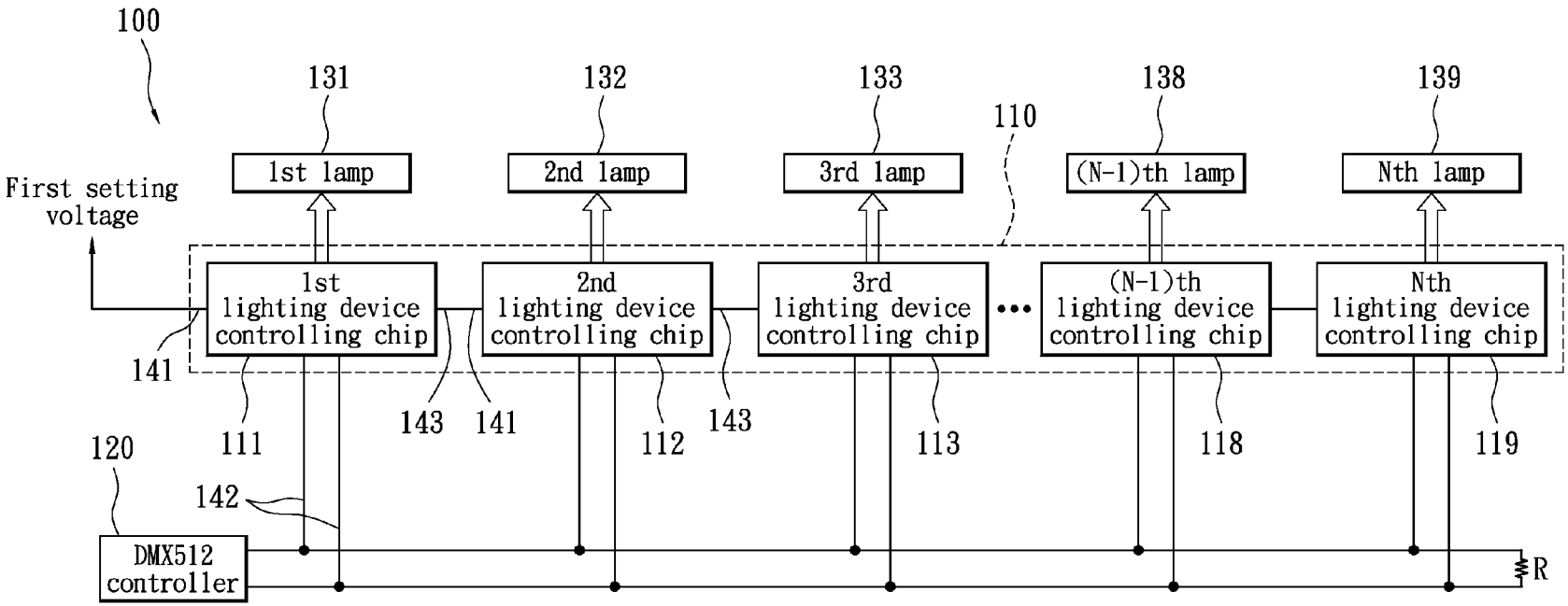
FIG. 1 shows a schematic diagram of a lighting system according to the first exemplary embodiment form the present disclosure.

Reference will now be made in detail to the exemplary embodiments of the present disclosure, examples of which are illustrated in the accompanying drawings. Wherever possible, the same reference numbers are used in the drawings and the description to refer to the same or like parts.

[First Exemplary Embodiment]

Please refer to FIG. 1 which shows a schematic diagram of a lighting system according to the first exemplary embodiment of the present disclosure. The lighting system 100 includes a plurality of lamps showed 131 to 139 sequentially. The lighting system 100 further includes a lighting device controlling apparatus 110 which includes the $1^{st}$ to the $N^{th}$ lighting device controlling chips 111 to 119. The $1^{st}$ to the $N^{th}$ lighting device controlling chips 111 to 119 are respectively coupled to lamps 131 to 139 for driving the lamps 131 to 139, wherein the N is a positive integer. In one implementation, the trigger terminal 141 is connected in series with the output terminal 143. Each of the lighting device controlling chips 111 to 119 includes a trigger terminal 141, a signal receiving interface 142, and an output terminal 143. The output terminal 143 of the front end lighting device controlling chip couples to the trigger terminal 141 of the next lighting device controlling chip. The trigger terminal 141 of the first lighting device controlling chip 111 couples to the first setting voltage, wherein the first setting voltage is a fixed DC voltage level (e.g., 5V or 3V, and the present invention is not limited thereto). The above-mentioned lamps may be lighting emitting diode (LED) lamps, and the present invention is not limited thereto.

The signal receiving interfaces 142 of the $1^{st}$ to the $N^{th}$ lighting device controlling chips 111 to 119 may be coupled to an output interface of a DMX512 controller 120 in parallel for receiving data packets that are in compliance with DMX512 standard. More specifically, every data packet that is in compliance with DMX512 standard has a plurality of serially transmitted data slots. As shown in the FIG. 1, the signal receiving interface 142 of the $1^{st}$ to the $N^{th}$ lighting device controlling chips 111 to 119 couples to the output interface of the DMX512 controller 120 by parallel connection for receiving DMX-based controlling signals (or data packet). In other words, both the trigger terminal 141 and the output terminal 143 of the $1^{st}$ to the $N^{th}$ lighting device controlling chips 111 to 119 may be regarded as single-line addressing interfaces that are serially connected with each other. The signal receiving interface 142 of the $1^{st}$ to the $N^{th}$ lighting device controlling chips 111~119 may be regarded as signal receiving interface and coupled to the output interface of the DMX512 controller 120 by parallel connection.

The output interface of the DMX512 controller 120 such as a RS485-based differential transmission interface may be considered as an EIA-485 transmission interface, and the present invention is not limited thereto. RS485 is a differential interface, therefore the terminal couples to the resistor R for forming a loop. The signal receiving interface 142 may be thus configured to receive EIA-485-based signals. The data packets that are outputted from the DMX512 controller 120 may be adjustable in order to satisfy corresponding system requirements. For example, the data packets may be outputted at a rate promulgated in DMX512 standard, or at a rate that doubles or even quadruples the rate in DMX512 standard, and the present invention is not limited thereto. The double rate or quadruple rate of DMX512 standard means doubling the frequency of the DMX512 for transmitting more data packets in the same period. Furthermore, in another implementation the signal receiving interface may be RDM (remote device management)-based, which shares the same timing specification with DMX 512 standard, returning the apparatus status to DMX controller by differential interface, so this interface may be a two-way transmission (i.e., receive and transmit) interface. It is worth noting that the signal receiving interface 142 may be implemented in terms of an RDM-based interface.

The $1^{st}$ to the $N^{th}$ lighting device controlling chips 111 to 119 may determine an address thereof according to a voltage level at the trigger terminals 141 and counting signals corresponding to the number of the received data slots, for determining positions of the lighting device controlling chips 111 to 119 in terms of the sequence (e.g., as the first or the second).

Using the first lighting device controlling chip 111 for an example of illustration, the first lighting device controlling chip 111 may count a number of the data slots upon receiving the data packet before generating the counting signal. There are many methods for counting the number of the data slots and one is for targeting signals that appear only once in every data slot. The signals that appear in the single time slot may include the start bit, 8-bit data, stop bits, and mark between slots. In other words, the method of the counting the number of the data slots may base on corresponding formats or signals of the data slots, and calculates the number of the data slots by indirect method.

When detecting the first setting voltage has been set to a predetermined voltage level (e.g., a logic "high" voltage level), the first lighting device controlling chip 111 may determine the address thereof according to the counting signal corresponding to the number of the received data slots. For example, if the first setting voltage is logic high voltage when system power on, the first lighting device controlling chip 111 may detect the voltage level at the trigger terminal 141 is at the "high" voltage level before receiving any data slot. Due to the number of the received data slots is zero, the first lighting device controlling chip 111 may determine that it is the "first" lighting device controlling chip with respect to other lighting device controlling chips in terms of the position in the sequence.

Thereafter the first lighting device controlling chip 111 may keep counting the number of the data slots after detecting the voltage level of the first setting voltage has been set to a predetermined voltage (such as logic "high" voltage of the exemplary embodiment). Then, setting the second setting voltage which is outputted from the output terminal 143 of the first lighting device controlling chip 111 to the predetermined voltage level (which may be the logic "high" voltage level) after an interval of a predetermined number of the data slots. In one implementation, the interval may be one data slot or two data slots in length.

Similarly, when the second lighting device controlling chip 112 detects the voltage level at the trigger terminal 141 thereof (or the second setting voltage which is outputted form the output terminal 143 of the first lighting device controlling chip 111) has been set to the logic "high" voltage, the second lighting device controlling chip 112 may determine the address thereof according to the counting signal corresponding to the number of the received data slots. For example, if the first lighting device controlling chip 111 sets the voltage level of the output terminal 143 thereof to the logic "high" voltage after the interval of one data slot, the second lighting device controlling chip 112 may detect the trigger terminal 141 thereof at the logic "high" voltage after receiving one data slot, before determining that the second lighting device controlling chip 112 itself is the second lighting device controlling chip in the sequence of the position.

Similarly, the $1^{st}$ to the $N^{th}$ lighting device controlling chips 111 to 119 may determine their corresponding positions and set addresses thereof according to the number of the received data slots when the voltage levels of the corresponding trigger terminals 141 have been set to the logic "high" voltage (or when trigger terminal 141 is triggered). Upon the $1^{st}$ to the $N^{th}$ lighting device controlling chips 111 to 119 have been addressed, the addressed lighting device controlling chips 131 to 139 may be configured to access the corresponding data slots of the data packet $1^{st}$ to drive the corresponding $1^{st}$ to the $N^{th}$ lamps 131-139. For example, the first lighting device controlling chip 111 may be configured to access the first data slot (slot 1) of the data packet, while the second lighting device controlling chip is configured to access the second data slot (slot 2) of the data packet. The other lighting device controlling chips accesses in the same way, and the description is omitted. Furthermore, it is noteworthy that the lighting device controlling chips also may access more than one data slot at one time solely based on whether their trigger terminals have been set to the predetermined voltage levels and the number of the data slots in the received counting signals. For example, the first device controlling chip 111 may access the first three data slots (slot 1 to slot 3) of the data packet, and the second lighting device controlling chip 112 accesses the next three data slots (slot 4~slot 6) of the data packet. The other lighting device controlling chips accesses the data slot in the same way, and the description is omitted. In other words, the $1^{st}$ to the $N^{th}$ lighting device controlling chips 111 to 119 may individually determine the address thereof according to the voltage level of the trigger terminal 141 thereof and the counting signal corresponding to number of the received data slots.

Figure 2:
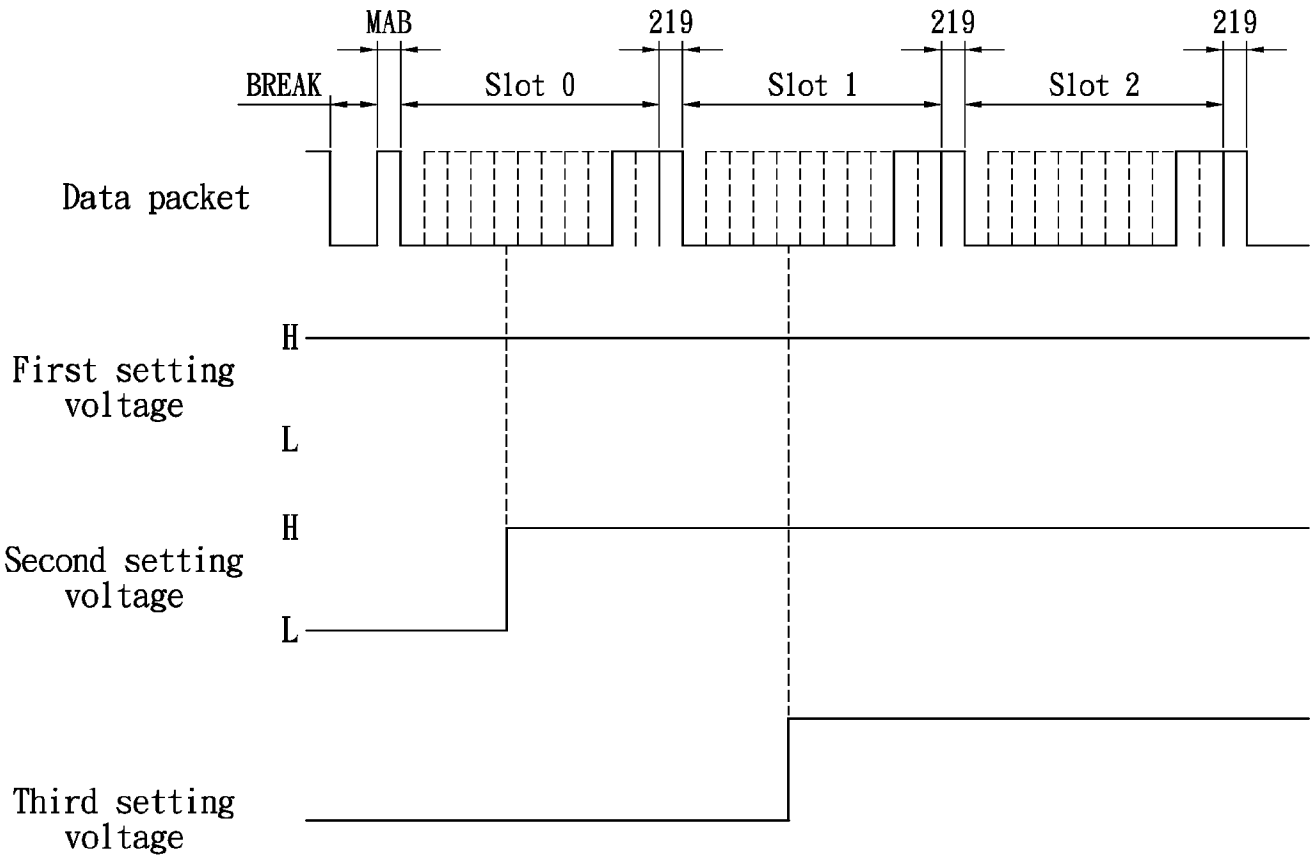
FIG. 2 shows a waveform diagram of the data packet according to the first exemplary embodiment from the present disclosure.

Next, according to a waveform of the data packet, the addressing method of the $1^{st}$ to the $N^{th}$ lighting device controlling chips 111 to 119 is further illustrated. Please refer to FIG. 1 in conjunction with FIG. 2. FIG. 2 is a waveform diagram of the data packet according to first exemplary embodiment of the present invention. Generally, the first data slot (slot 0) in the DMX512-based data packet is the start code, which is utilized to differentiate the type of the connected lamps and represented by start data slot in the present embodiment. In the exemplary embodiment of the present disclosure, the data slots such as slot 1 to slot 512 are for carrying data associated with lamp driving. The data the DMX512-based data packet may also include "BREAK," Mark Time after BREAK (MAB), start code (in start data slot or slot 0), channel data (in the $1^{st}$ to the 512$^{th}$ data slot or in the slot 1 to slot 512 which are after the start data slot or slot 0, and FIG. 2 doesn't show all data slots), and Mark Time between Slots 219. Please refer to the specification of the DMX512 standard for more details, and the description is omitted.

In FIG. 2, the first setting voltage may correspond to the received voltage from the trigger terminal 141 of the first lighting device controlling chip 111, the second setting voltage may correspond to the received voltage from the trigger terminal 141 of the second lighting device controlling chip 112 (which is the output voltage from the output terminal 143 of the first lighting device controlling chip 111) and the third setting voltage may be indicative of the received voltage from the trigger terminal 141 of the third lighting device controlling chip 113 (which is the output voltage from the output terminal 143 of the second lighting device controlling chip 112).

When the system having the lighting device controlling chips is powered, the first setting voltage is set to the logic "high" voltage (H), resulting in the first lighting device controlling chip 111 to be considered as the first of all lighting device controlling chips in terms of the sequence in position. And after the interval of one data slot, the first lighting device controlling chip 111 may set the second setting voltage to the logic "high" voltage (H) also, for triggering the addressing of the second lighting device controlling chip 112. Since the second setting voltage that triggers the second lighting device controlling chip 112 may be set to the logic "high" voltage during the interval of slot 0, the second lighting device controlling chip 112 may detect slot 0 and thereby setting the address thereof to the second lighting device controlling chip in the sequence of the position. Similarly, since the second lighting device controlling chip 112 may set the output voltage of the output terminal 143, which triggers the third lighting device controlling chip 113, to the logic "high" after detecting slot 1, the subsequent lighting device controlling chip (or the third lighting device controlling chip) may determine the position thereof in the sequence accordingly.

Furthermore, it is noteworthy that the voltage at the output terminal of the lighting device controlling chip may be set at any point of the interval during which the data slot or the data slots are transmitted, as shown in the second setting voltage of the FIG. 2, as long as the lighting device controlling chip may successfully and accurately count the number of the received data slots. According to the other exemplary embodiment of the present disclosure, the output terminal voltage also may be set after the completion of the transmission of the data slot(s), and the present invention is not limited thereto. Therefore, the lighting device controlling chips of the present disclosure may determine their positions in the sequence automatically and access the corresponding data slots according to addresses (i.e., the positions in the sequence) of the lighting device controlling chips. In the lighting device controlling chip, the intervals, which was since the trigger terminal 141 triggered (received the setting voltage of the predetermined voltage level) until converted to the output setting voltage outputted from the output terminal 143, might be one or a plurality data slots (or the data slot period). It is worth noting that the intervals of the data slots may be the same in length, thus the lighting device controlling chips may deduce the self-sequence by way of the counting the received data slots.

For example, if the interval is two data slots in length and when the lighting device controlling chip was triggered after or upon ten data slots have been received, the lighting device controlling chip may be considered as the sixth lighting device controlling chip in terms of the sequence among all lighting device controlling chips. Furthermore, in the exemplary embodiment of the present disclosure, the number of the serially connected lighting device controlling chips is not limited (such as two or a plurality of the lighting device controlling chips). According to the above-mentioned exemplary embodiment description, those skilled in the art should be able to deduce the other embodiments according to the disclosure of the present invention, and the description is omitted.

Additionally, in the exemplary embodiment, the $1^{st}$ to the $N^{th}$ lighting device controlling chips 111 to 119 may reset their addresses or utilize the same addresses when a new data packet is received, and the exemplary embodiment is not limited thereto. For example, when the first setting voltage is set to a logic "low" voltage or grounded, the above-mentioned first to the $N^{th}$ lighting device controlling chips 111 to 119 may utilize the same addresses that have been determined when the first setting voltage is set to the logic "high" voltage without resetting the corresponding addresses.

Figure 3:
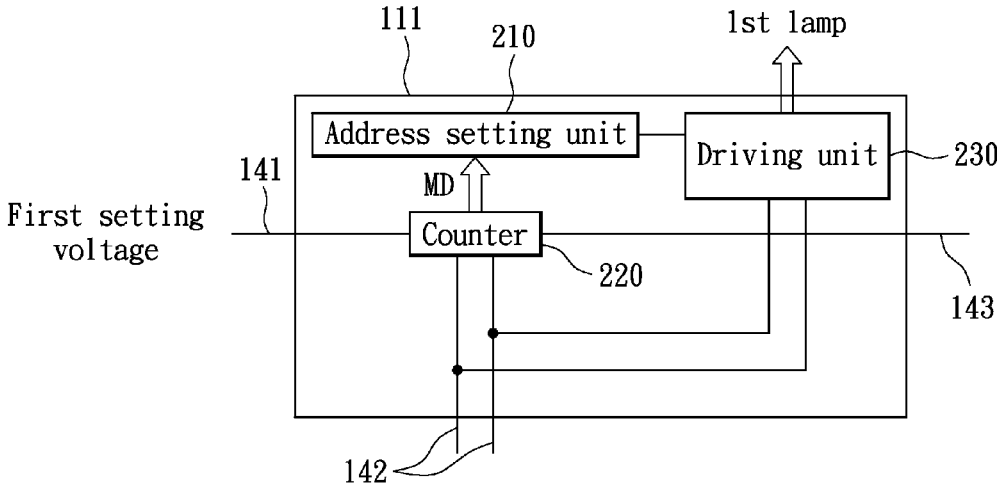
FIG. 3 shows a circuit diagram for the lighting device controlling chip according to the first exemplary embodiment from the present disclosure.

The method of addressing the $1^{st}$ to the $N^{th}$ lighting device controlling chips 111 to 119 may be implemented in firmware or circuit, and the present invention is not limited thereto. Please refer to FIG. 3 which is a circuit diagram of the lighting device controlling chip according to the first exemplary embodiment of the present disclosure. Assume the lighting device controlling chip in FIG. 3 is the first lighting device controlling chip 111, and the other lighting device controlling chips which have the same structures may be deduced. Please refer to the FIG. 3, the first lighting device controlling chip 111 includes an address setting unit 210, a counter 220 and a driving unit 230. The counter 220 is coupled to the signal receiving interface 142, the trigger terminal 141, the output terminal 143 and the address setting unit 210. The driving unit 230, meanwhile, is coupled to the address setting unit 210 and the signal receiving interface 142 for accessing the data slot of the data packet according to the address or the position in the sequence.

The counter 220 is for counting the number of the received data slots and outputting the counting signal MD corresponding to the number of the received data slots to the address setting unit when the voltage level of the first setting voltage is set to the predetermined voltage (e.g. logic high voltage). The address setting unit 210 therefore sets the address according to the counting signal MD. Then, according to the address, the driving unit 230 may drive one or a plurality of the lamps connected to the first lighting device controlling chip 111 by accessing the corresponding one or a plurality of the data slots in the received data packet. It is noteworthy that the above-mentioned voltage received at the trigger terminal 141 may be outputted from the driving unit 230, and the above-mentioned FIG. 3 is an exemplary embodiment of the present disclosure only, and the present invention is not limited thereto. In the exemplary embodiment, the above-mentioned predetermined voltage of the first setting voltage may be the logic "low" voltage despite the present disclosure is illustrated depending on whether the first setting voltage is at the logic "high" voltage or not, but in the other exemplary embodiment, the above-mentioned predetermined voltage may be setting logic low voltage according to the design requirement, and the present invention is not limited thereto.

[Second Exemplary Embodiment]

Figure 4:
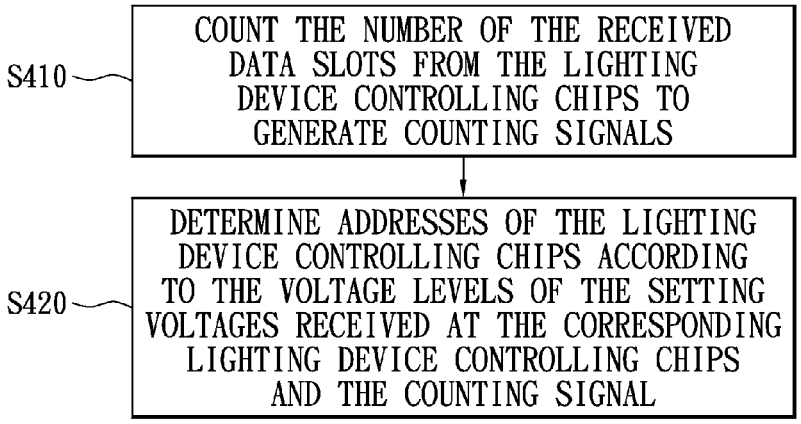
FIG. 4 shows a simplified flow chart illustrating a method of addressing the lighting device controlling chips according to the first exemplary embodiment from the present disclosure.

According to the descriptions of the above-mentioned exemplary embodiment, the present disclosure discloses a method of addressing the lighting device controlling chips, each of which is associated with a trigger terminal for receiving a first setting voltage, an output terminal for outputting a second setting voltage, and a signal receiving interface for receiving a data packet having a plurality serial transmitted data slots. Please refer to FIG. 4 which is a simplified flow chart illustrating the addressing method according to the second exemplary embodiment of the present disclosure. The method includes counting the number of the data slots received from the lighting device controlling chip for generating a counting signal (step S410), and according to the voltage level of the first setting voltage and the counting signal corresponding to the number of the received data slots for determining an address of the lighting device controlling chip (step S420). Step S420 further includes determining the address of the first lighting device controlling chip according to the number of the received data slots when the voltage level of the first setting voltage has been reaching a predetermined voltage, and setting the second setting voltage to the predetermined voltage (e.g., logic "high" voltage) after an interval of a predetermined number of the data slots. Other details of addressing method in the present disclosure, those skilled in the art should be able to deduce the other embodiments according to the above-mentioned description of the first exemplary embodiment, and the description is omitted.

Furthermore, it is noteworthy that the coupling relation between above-mentioned components includes direct or indirect electrical connections as long as electrical signal transmission may be achieved, and the present disclosure is not limited thereto. The techniques described in the above-mentioned embodiments may be combined or used independently, further the associated components may add, delete, modify or replace according to the requirements of both functional and designed, and the present invention are not limited thereto.

In summary, the lighting device controlling chips of the present disclosure may delay the transmission of the setting voltage according to the timing of the data slots, and determine the address thereof automatically by counting the number of the received data slots base on the characteristics associated with the DMX512-based data packet and the delay timing in transmission of the setting voltage.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A lighting device controlling chip adapted to drive one or a plurality of lamps, according to a first setting voltage and a data packet comprising a plurality of serially transmitted data slots, comprising:

a trigger terminal for receiving the first setting voltage;

an output terminal for outputting a second setting voltage; and a signal receiving interface for receiving the data packet;

wherein the lighting device controlling chip determines an address thereof according to a voltage level of the first setting voltage and a counting signal corresponding to a number of the received data slots.

2. The lighting device controlling chip according to claim 1, wherein when detecting the voltage level of the first setting voltage has been set to a predetermined voltage level the lighting device controlling chip determines the address of the lighting device controlling chip according to the counting signal, and sets the second setting voltage outputted from the output terminal into the predetermined voltage level after an interval of a predetermined number of the data slots.

3. The lighting device controlling chip according to claim 1, wherein the lighting device controlling chip further comprises:

a counter coupled to the signal receiving interface and the trigger terminal for counting the number of the received data slots and outputting the counting signal corresponding to the number of the received data slots as the voltage level of the first setting voltage has been set into the predetermined voltage level;

an address setting unit coupled to the counter for setting the address according to the counting signal; and a driving unit coupled to the address setting unit and the signal receiving interface, for driving the one or a plurality lamps connected to the lighting device controlling chip by accessing the data slots of the data packet received according to the address.

4. The lighting device controlling chip according to claim 1, wherein the data packet is in compliance with DMX512 standard, the first setting voltage is a direct current (DC) voltage and the signal receiving interface is adapted to receive signals complying with EIA-485 standard.

5. A lighting device controlling apparatus adapted to drive a plurality of lighting devices according to a first setting voltage and a data packet having a plurality of serially transmitted data slots, comprising:

a first lighting device controlling chip having a first trigger terminal for receiving the first setting voltage, a first output terminal for outputting a second setting voltage and a first signal receiving interface for receiving the data packet; and a second lighting device controlling chip having a second trigger terminal, a second output terminal and a second signal receiving interface, wherein the second trigger terminal is coupled to the first output terminal and the second signal receiving interface is configured to receive the data packet;

wherein the first lighting device controlling chip determines a first address of the first lighting device controlling chip according to a voltage level of the first setting voltage and a first counting signal corresponding to a number of the data slots received by the first lighting device controlling chip, while the second lighting device controlling chip determines a second address of the second lighting device controlling chip according to a voltage level of the second setting voltage and a second counting signal corresponding to a number of the data slots received by the second lighting device controlling chip.

6. The lighting device controlling apparatus according to claim 5, wherein when detecting the voltage level of the first setting voltage has been set to a predetermined voltage level the first lighting device controlling chip determines the first address of the lighting controlling chip according to the first counting signal, and sets the second setting voltage outputted from the output terminal into the predetermined voltage level after an interval of a predetermined number of the data slots.

7. The lighting device controlling apparatus according to claim 5, wherein the first lighting device controlling chip further comprises:

a counter coupled to the first signal receiving interface and the first trigger terminal for counting the number of the received data slots to generate the first counting signal;

an address setting unit coupled to the counter for setting the first address according to the first counting signal; and a driving unit coupled to the address setting unit and the first signal receiving interface, for driving one or a plurality of lamps connected to the first lighting device controlling chip by accessing the data slots of the data packet received at the address.

8. The lighting device controlling apparatus according to claim 5, wherein the data packet is in compliance with DMX 512 standard, the first setting voltage and the second setting voltage are a direct current (DC) voltage, and the first receiving interface and the second signal receiving interface adapted for receiving signals comply with EIA-485 standard.

9. A lighting system, comprising:

a plurality of lamps;

a lighting device controlling apparatus coupled to the lamps for driving the lamps according to a first setting voltage and a data packet, wherein the lighting device controlling apparatus further comprises:

a first lighting device controlling chip having a first trigger terminal for receiving the first setting voltage, a first output terminal for outputting a second setting voltage, and a first signal receiving interface for receiving the data packet; and a second lighting device controlling chip having a second trigger terminal, a second output terminal, and a second signal, wherein the second trigger terminal is coupled to the first output terminal and the second signal receiving interface is configured to receive the data packet;

wherein the first lighting device controlling chip determines a first address of the first lighting device controlling chip according to the voltage level of the first setting voltage and a first counting signal corresponding a number of the data slots received by the first lighting device controlling chip, while the second lighting device controlling chip determines a second address of the second lighting device controlling chip according to the voltage level of the second setting voltage and a second counting signal corresponding the number of the received data slots by the second lighting device controlling chip.

10. A method for addressing a lighting device controlling chip, adapted to a lighting device controlling chip having a trigger terminal for receiving a first setting voltage, an output terminal for outputting a second setting voltage and a signal receiving interface for receiving a data packet having a plurality of serial transmitted data slots, comprising:

counting a number of the data slots received by the lighting device controlling chip to generate a counting signal; and determining an address of the lighting device controlling chip according to a voltage level of the first setting voltage and the counting signal corresponding the number of the received data slots.

11. The method for addressing the lighting device controlling chip according to claim 10, wherein the step of determining the address of the lighting device controlling chip further comprises:

when detecting the voltage level of the first setting voltage has been set to a predetermined voltage level, determining the first address of the lighting controlling chip according to the counting signal and setting the second setting voltage outputted from the output terminal into the predetermined voltage level after an interval of a predetermined number of the data slots.

12. The method for addressing the lighting controlling chip according to claim 10, wherein the data packet is in compliance with DMX512 standard, the first setting voltage is a direct current (DC) voltage and the first signal receiving interface is configured to receiving signals in compliance with EIA-485 standard.

* * * * *